US005766272A

United States Patent [19]

Lozzi

[11] Patent Number: 5,766,272

[45] Date of Patent: Jun. 16, 1998

[54] ADDITIVE COMPOSITION FOR DIESEL FUEL FOR ENGINE DRIVEN VEHICLES

[75] Inventor: Orlando Lozzi, Brescia, Italy

[73] Assignee: Globe S.p.A., Pettoranello Di Molise, Italy

[21] Appl. No.: 870,977

[22] Filed: Jun. 6, 1997

[51] Int. Cl.[6] ..... C10L 1/88; C10L 1/22

[52] U.S. Cl. ..... 44/324; 44/326; 44/387; 44/437

[58] Field of Search ..... 44/324, 326, 387, 44/437

[56] References Cited

U.S. PATENT DOCUMENTS

| | | | |
|---|---|---|---|
| 1,849,051 | 3/1932 | Helmore | 44/326 |
| 2,496,444 | 2/1950 | Cook | 44/437 |
| 4,541,837 | 9/1985 | Norton et al. | 44/326 |
| 4,891,049 | 1/1990 | Dillion et al. | 44/387 |

*Primary Examiner*—Stephen Kalafut
*Assistant Examiner*—Cephia D. Toomer
*Attorney, Agent, or Firm*—McGlew and Tuttle

[57] ABSTRACT

The invention concerns a composite additive for diesel fuel for engine driven vehicles containing Dimethylcarbonate, ethylic aldehyde and ethyl nitrate mixed together. The composite additive is added to the diesel fuel in an effective quantity from 4 to 5 v/v % to improve the combustion of said diesel fuel in endothermic Diesel cycle engines.

9 Claims, No Drawings

ADDITIVE COMPOSITION FOR DIESEL FUEL FOR ENGINE DRIVEN VEHICLES

FIELD OF THE INVENTION

The present invention concerns the field of fuels for internal combustion engines with particular reference to a composite additive for diesel fuel for endothermic engines with a Diesel cycle.

PRIOR ART AND PROBLEMS

The use of additives in diesel fuel for endothermic engines with a Diesel cycle is already known. The known additives are however mainly for conserving the mechanical components of an engine, that is the injectors, the injection pump etc., and to help keep the engine incrustation free (decarbonization). Their aim is to limit maintenance and to improve the mechanical operation of the engine.

Ester based substances are sometimes added to Diesel engine driven vehicle fuel to improve cold starting of an engine particularly during the Winter season.

However, although there are various types of additives for diesel engine driven vehicle fuel on the market, the problems connected with a real improvement in diesel fuel combustion in Diesel engines have neither ever been faced nor resolved in an organic way. These engines do not burn their fuel completely and consequently they are responsible for releasing unburned hydrocarbon particles in the atmosphere.

In fact, among the various harmful substances present in the polluted atmosphere of urban areas, besides carbon monoxide whose effects are well known to everybody, there are particulates, that is unburned sooty particles expelled by Diesel engines which are irritants and cancerogenic and besides which represent in themselves an enormous waste, both from an energy and economic point of view.

OBJECT AND ADVANTAGES OF THE INVENTION

The aim of the present invention is to achieve an important improvement in the combustion of diesel fuel in endothermic Diesel engines, producing at the same time a substantial reduction in unburned substances (particulates) and a lowering of nitrogen oxides (NOx) and carbon monoxide (CO) levels in exhaust gasses expelled by said engines.

Therefore the overall performance of engines running on diesel fuel is favorably increased and the polluting effects are noticeably reduced producing at the same time a saving of energy and costs.

DISCLOSURE OF THE INVENTION

This aim and said advantages are achieved by the composite additive of the present invention and the use of Diesel engine fuel containing an appropriate quantity of said composition.

The composite additive of the invention includes (i) dimethylcarbonate (C3 H6 O3), (ii) ethylic aldehyde (iii) ethyl nitrate (CH3 CH2 ON02)

mixed in the proportions specified below and added to diesel engine fuel in effective volume quantities.

Components (i), (ii) and (iii) carry out respectively oxygenating, pre-detonating and igniting functions of diesel fuel in Diesel cycle engines. When formulated in the composite additive added to any type of Diesel oil for vehicle engines, they carry out their respective functions in the engine combustion chamber improving the reaction kinetics and homogeneity in the propagation of the so called flame front.

The results are a really consistent reduction (from 35 to 50%) of unburned substances (particulates) released by the engine together with a lowering (from 20 to 35%) of nitrogen oxides (NOx) and carbon monoxide (CO) levels in the exhaust gasses without any negative effect on engine function, on performance and speed of same.

DETAILED DESCRIPTION OF THE INVENTION

The invention therefore proposes a composite additive and made up of (i) dimethylcarbonate (ii) ethylic aldehyde (iii) ethyl nitrate in the following proportions, in volume:

(i) from 50 to 75 v %, preferably from 60 to 70 v %;

(ii) from 25 to 40 v %, preferably from 30 to 35 v %;

(iii) from 10 to 15 v %, preferably from 12 to 13 v %.

The components, easily found on the market, are accurately mixed together at room temperature and atmospheric pressure to form a mixture which is then added to the diesel fuel in the correct quantity. The addition of the composite additive to the diesel fuel can be carried out either during any of the final stages of refining of same or later directly before delivering to distribution pumps and/or fuel tanks of vehicles.

The effective quantity of composite additive to be added to the diesel fuel is from 3.5 to 5.5 v % based on the volume of diesel. In preference, the ratio of the composite additive of the invention to the diesel fuel to which it is added is from 4 to 5 v %, in volume.

In other words, components (i), (ii) and (iii) of the composite additive develop their effectiveness when the composite additive is added to the diesel fuel in a ratio of 4 to 5% v/v %. In proportion, 100 liters of diesel fuel, when additivated, will contain between 4 to 5 liters of such composite additive of the invention. In the same way again, the diesel fuel which has received the additive will contain (i) dimethylcarbonate in a ratio of about 2.0 to 2.9 v/v %

(ii) ethylic aldehyde in a ratio of about 1.1 to 1.7 v/v %.

(iii) ethyl nitrate in a ratio of about 0.4 to 0.6 v/v %;

Components (i), (ii) and (iii) acting in synergy produce a more complete combustion of the diesel fuel during the Diesel cycle resulting in an improvement in the thermodynamics of the engine.

TESTS 1000 liters of diesel fuel were prepared to which were added 43 liters of the composite additive of the invention obtained by mixing 25 liters of component (i), 13 liters of component (ii) and 5 liters of component (iii).

Numerous tests were then carried out using various types of Diesel engines, both slow and fast, with different horsepowers and combustion chamber configurations (direct injection, precombustion chamber, etc.). The resulting weight average produced a range of values on exhaust gas emissions in line with the percentage ratios of the individual components of the composition.

The results showed a drop of about 35 to 50% in particulates and a 20 to 30% reduction in nitrogen oxides (NOx) and carbon monoxide (CO) levels.

Both new and used engines were used without any changes and without any faults in operation being revealed.

From the checks carried out after the tests the engines showed no signs of damage whatever.

Particular tests were carried out on an engine with a maximum horsepower of 55 HP, using about 50% of its rated power.

The engine was fed with Diesel fuel sold on the market and then with the same Diesel fuel with the addition of between 4 and 5% of the composition of the invention. The controls were carried out using the following sample and analysis methods.

Temperature of Fumes

Measured using a digital thermometer and thermometric probe, carried out in various points along the exhaust pipe and during various moments of sampling in order to reach the average value of the set parameter.

Flow of Fumes (Unichem Method 467/86)

Finding the average differential pressure using a Pitot tube connected to a mechanical manometer (Magnehelic).

The readings for differential pressure were carried out in the exhaust pipe following the indications given in M.U. 422 (General principles for the choice of measuring points and sampling).

Total Particulates (Unichem Method 494/79)

Sampling using an isokinetic probe on a glass fibre filter sublayer.

The type of particulate was established using differentiated gravimetry (the filter is dried at 105° C. and weighed before and after taking the sample).

Nitrogen oxides, carbon monoxide and oxygen (POP 90010 R.0.)

Automatic electrochemical cell analyzer.

The results confirmed the reduction of particulates and lowering of nitrogen oxide and carbon monoxide levels in the fumes on an average within the percentage values indicated above.

Dimethylcarbonate, ethylic aldehyde and ethyl nitrate mixed together have such a high thermal value that the Cetane rating (CR) of the diesel fuel integrated with the composite additive does not vary much in the typical values of market available diesel fuels.

This demonstrates not only the excellent compatibility, but also the efficiency of the reformulation obtained in this way.

What is claimed is:

1. A composite additive for Diesel fuel for engine driven vehicles containing 50 to 75% by volume of dimethylcarbonate, from 25 to 40% by volume of ethylic aldehyde and from 10 to 15% by volume of ethyl nitrate.

2. The composite additive as claimed in claim 1, which contains a quantity by volume of from 60 to 70% dimethylcarbonate, from 30 to 35% ethylic aldehyde and from 12 to 13% ethyl nitrate.

3. A method for improving the combustion of diesel fuel in endothermic engines with Diesel cycle, including the addition of an effective quantity of the composite additive claimed in claim 1 to the diesel fuel.

4. The method according to claim 3, where the effective quantity of the composite additive is from 3.5 to 5.5% by volume on the basis of the diesel fuel.

5. The method according to claim 4, where the effective quantity of the composite additive is from 4 to 5% by volume on the basis of the diesel fuel.

6. A diesel fuel for engine driven vehicles containing an effective quantity of the composite additive claimed in claim 1.

7. A diesel fuel for engine driven vehicles according to claim 6, which contains a quantity of composite additive from 3.5 to 5.5% by volume on the basis of the diesel fuel.

8. A diesel fuel for engine driven vehicles according to claim 7, which contains a quantity of composite additive from 4 to 5% by volume on the basis of the diesel fuel.

9. A diesel fuel for engine driven vehicles according to claim 8, which contains dimethylcarbonate in a quantity in volume of from 2.0 to 2.9%, ethylic aldehyde in a quantity in volume of from 1.1 to 1.7% and ethyl nitrate in a quantity in volume of from 0.4 to 0.6% on the basis of the diesel fuel.

* * * * *